US011624591B2

(12) United States Patent
Norman

(10) Patent No.: US 11,624,591 B2
(45) Date of Patent: Apr. 11, 2023

(54) FRAMELESS BULLET TRAP

(71) Applicant: ODIN TARGET AB, Vallentuna (SE)

(72) Inventor: Peter Norman, Stockholm (SE)

(73) Assignee: ODIN TARGET AB, Stockholm (SE)

( * ) Notice: Subject to any disclaimer, the term of this patent is extended or adjusted under 35 U.S.C. 154(b) by 518 days.

(21) Appl. No.: 16/686,715

(22) Filed: Nov. 18, 2019

(65) Prior Publication Data

US 2020/0232771 A1 Jul. 23, 2020

Related U.S. Application Data

(63) Continuation of application No. 16/082,668, filed as application No. PCT/EP2017/055433 on Mar. 8, 2017, now Pat. No. 10,520,285.

(30) Foreign Application Priority Data

Mar. 9, 2016 (SE) ..... 1650319-5

(51) Int. Cl.
*F41J 13/00* (2009.01)
*F41H 5/02* (2006.01)
*F41H 5/013* (2006.01)

(52) U.S. Cl.
CPC ..... *F41J 13/00* (2013.01); *F41H 5/013* (2013.01); *F41H 5/026* (2013.01)

(58) Field of Classification Search
CPC ..... F41J 13/00; F41H 5/026; F41H 5/013
See application file for complete search history.

(56) References Cited

U.S. PATENT DOCUMENTS 1,992,001 A * 2/1935 Caswell ..... F41J 13/02 273/404
2,743,106 A * 4/1956 Schels ..... F41J 13/02 273/394
2,772,092 A * 11/1956 Nikoden ..... F41J 13/00 273/410
3,737,165 A * 6/1973 Pencyla ..... F41J 13/00 73/167

(Continued)

FOREIGN PATENT DOCUMENTS

DE 202004005719 8/2004
DE 202008013022 4/2009

(Continued)

OTHER PUBLICATIONS

International Search Report on corresponding PCT application (PCT/EP2017/055433) from International Searching Authority (EPO) dated May 4, 2017.

(Continued)

*Primary Examiner* — Joshua E Freeman
(74) *Attorney, Agent, or Firm* — KOS IP Law LLP

(57) ABSTRACT

A slat arrangement for redirecting the trajectory of a bullet has a plurality of elongated steel slats, and each elongated steel slat has a longitudinal front edge and a longitudinal back edge stretching between a first end and a second end. The steel slats are positioned in a louver-like fashion for changing the direction of a bullet following a trajectory along the normal of the slat arrangement. A support structure is connected to each steel slat at the back edge of the steel slat, between the first end and the second end of the steel slat.

18 Claims, 7 Drawing Sheets

(56) References Cited

U.S. PATENT DOCUMENTS

| | | | | |
|---|---|---|---|---|
| 4,470,604 | A * | 9/1984 | Hoffmann | F42B 33/00 273/404 |
| 4,512,585 | A * | 4/1985 | Baravaglio | F41J 13/00 273/410 |
| 4,683,688 | A | 8/1987 | Wojcinski | |
| 5,040,802 | A * | 8/1991 | Wojcinski | F41J 13/00 273/410 |
| 5,639,069 | A * | 6/1997 | McClure | E04H 17/1408 256/25 |
| 5,718,434 | A * | 2/1998 | Alward | F41J 13/00 89/36.02 |
| 5,749,177 | A * | 5/1998 | Pontus | F41J 13/00 273/410 |
| 8,162,321 | B1 * | 4/2012 | Shank, Jr. | F41J 13/00 273/410 |
| 8,469,364 | B2 * | 6/2013 | Bassett | F41J 11/02 273/410 |
| 9,217,623 | B2 * | 12/2015 | Sovine | F41J 11/02 |
| 10,012,479 | B2 * | 7/2018 | Boviall | F41H 5/24 |
| 2003/0177895 | A1 * | 9/2003 | Lambert | F41J 13/00 89/1.1 |
| 2005/0034594 | A1 * | 2/2005 | Parks | F41J 13/00 89/1.11 |
| 2010/0206158 | A1 * | 8/2010 | Neethling | F41H 5/023 89/36.02 |
| 2011/0260407 | A1 * | 10/2011 | Norman | F41J 13/00 273/410 |
| 2012/0126480 | A1 * | 5/2012 | Bassett | F41J 11/02 273/410 |
| 2014/0284881 | A1 * | 9/2014 | Sovine | F41J 13/00 273/410 |
| 2015/0268005 | A1 * | 9/2015 | Keren | F41H 5/013 89/36.02 |
| 2017/0030689 | A1 * | 2/2017 | Ferguson | F41H 5/24 |
| 2017/0241749 | A1 * | 8/2017 | Boviall | F41H 5/06 |

FOREIGN PATENT DOCUMENTS

| | | |
|---|---|---|
| DE | 202009008981 | 9/2009 |
| DE | 202010006663 | 8/2010 |
| DE | 202013004866 | 6/2013 |
| EP | 2781876 | 9/2014 |
| SE | 532678 | 3/2010 |
| WO | WO2009035401 | 3/2009 |

OTHER PUBLICATIONS

Written Opinion on corresponding PCT application (PCT/EP2017/055433) from International Searching Authority (EPO) dated May 4, 2017.

* cited by examiner

FRAMELESS BULLET TRAP

CROSS-REFERENCE TO RELATED APPLICATION

This application is a continuation of co-pending U.S. patent application Ser. No. 16/082,668, filed Sep. 6, 2018, which is a National Phase, under 35 U.S.C. § 371(c), of International Application No. PCT/EP2017/055433, filed Mar. 8, 2017, which claims priority from Swedish Application No. SE 1650319-5, filed Mar. 9, 2016. The disclosures of all of the referenced applications are incorporated herein by reference in their entireties.

FEDERALLY SPONSORED RESEARCH OR DEVELOPMENT

Not Applicable

TECHNICAL FIELD OF THE INVENTION

The present invention relates generally to the field of bullet traps for shooting ranges, and in particular to bullet traps for indoor shooting ranges. Further, the present invention relates specifically to slat arrangements having steel slats positioned in a louver-like fashion for changing the direction of bullets.

BACKGROUND OF THE INVENTION

There are bullet traps for shooting ranges that have inclined steel slats, or plates, that change the trajectory of bullets to have a significant downward component. The plates are positioned in parallel to form a grille or louver-like arrangement. Both ends of each plate typically engage a frame holding the plate in place. The frame can be constituted by the thin walls of a cabinet, or a pair of mounting poles. These kinds of bullet traps are typically installed indoors where floor area is limited, since they are comparatively compact.

A frame of a bullet trap presents an area to a shooter that can cause a bullet to ricochet. This may cause damage to surrounding equipment, or even present a hazard to the shooter. This is particularly an issue if rifle ammunition, or other high velocity ammunition, is used. In addition, high velocity bullets may cause significant wear on the steel slats, as compared to pistol ammunition, thus requiring maintenance and replacement of the steel plates.

In the above described bullet traps, the bullets, or fragments of the bullets, typically end up below the steel plates. The scrap material may build up quickly and may require frequent maintenance for removal of the material. This is typically done by hand, and sometimes by some kind of suction equipment. The limited space for indoor installations typically means that the bullet trap is not accessible from the back, and that other equipment is positioned in front of the bullet trap, such as shooting targets or rubber blankets or mats for preventing bullet fragments from leaving the bullet trap.

Vibrations are caused when bullets hit the steel slats and other steel components of the above described bullet traps. If installed indoors, the vibrations are easily transferred via floors and walls to other parts of the building. Noise is thus generated in the building when the bullet traps are used.

Bullet traps of the above described type are disclosed in U.S. Pat. No. 5,749,177, DE 202004005719, and WO 2009/035401.

OBJECT OF THE INVENTION

The present invention aims at obviating the aforementioned disadvantages and failings of previously known bullet traps, and at enabling an improved bullet trap. An object of the present invention is to reduce the risk of ricochets. A further object of the invention is to improve the resistance to high-velocity bullets. Another object is also to make the bullet trap more resilient to rifle bullets, and also suitable for indoor use.

SUMMARY OF THE INVENTION

According to a first aspect of the present invention a slat arrangement for changing the direction of a bullet is provided. The slat arrangement comprises: a plurality of elongated steel slats, wherein each elongated steel slat has a longitudinal front edge and a longitudinal back edge stretching between a first end and a second end. It further comprises: a support structure for supporting the plurality of steel slats.

The steel slats are positioned in a louver-like fashion for changing the direction of a bullet following a trajectory along the normal of the slat arrangement. The positioning may also have the function that it prevents a bullet fired along the normal of the slat arrangement to pass through the slat arrangement without hitting a steel slat.

The support structure may be connected to each steel slat at the back edge of the steel slat and between the first end and the second end of the steel slat. Between the first end and the second end is here understood to not include the first end and the second end, or that the support structure is connected to each steel slat at a point distant from the first end and the second end. This has the effect that the risk of hitting the support structure is reduced, since it connected to the back edges. Further, no frame is required for supporting the steel slats, which in turn means that the risk of ricochets is reduced.

A slat is here understood to have a unitary or uncombined body. It may be formed from or constitute a single piece of sheet metal. For example, this may be achieved by cutting the slat from a larger piece of sheet metal.

The front edges of the steel slats may be parallel and/or define a common plane. Further, the normal of the slat arrangement may correspond to the normal of the common plane. Alternatively or additionally, the normal of the slat arrangement may correspond to the normal of the front of the slat arrangement. The normal of the slat arrangement is understood to encompass or correspond to the trajectory, or direction, of a bullet fired straight at the front of the slat arrangement.

That the steel slats are positioned in a louver-like fashion is understood to encompass the steel slats being parallel and slanted with respect to the normal of the slat arrangement. Alternatively or additionally, it is understood to encompass the separation between the front edges corresponding to, or being equal to, the separation between the back edges of neighboring steel slats.

The slat arrangement may be oriented for directing a bullet having a horizontal direction in a downward direction or in a direction having a downward component.

The steel slats may extend from the support structure for allowing a bullet having a trajectory along the normal of the slat arrangement to pass between the front edges of a pair of neighboring steel slats prior to reaching or passing the support structure. This has the effect that the risk of ricochets against the support structure is reduced, and that the surroundings to some extent are shielded from ricochets by the steel slats.

The support structure may comprise: an elongated flat steel bar having an elongated flat first side surface and an elongated flat second side surface, wherein the first side surface and the second side surface are parallel and the flat steel bar is positioned with the first side surface and the second side surface parallel to the normal of the slat arrangement. This has the effect that the area facing a shooter is reduced, thus reducing the risk of ricochets. The steel bar may connect to each steel slat at the back edge of the steel slat. This has the effect that the steel bar, at least to some extent, is shielded from a direct hit by a bullet, thereby reducing the risk of ricochets.

The steel bar may be formed from or constitute a single piece of flat sheet metal. The steel bar may have a first front edge and may comprise a plurality of cut-outs from the first side surface to the second side surface. This is understood to encompass each cut-out reaching from the first side surface to the second side surface. Each cut-out has an opening at, or in, the first front edge, and encloses a portion of a steel slat located at the back edge of the steel slat. This has the effect that the connections between the slats and the support structure do not contribute to an increased area facing a shooter, thereby reducing the risk of ricochets.

Each cut-out may be formed with a leaf-spring biasing the portion of the steel slat that is enclosed by the cut-out for maintain the position of the steel slat with respect to the steel bar. This is understood to encompass each cut-out forming the leaf-spring from a portion of the steel bar, wherein the leaf-spring biases the portion of the steel slat that is enclosed by the cut-out. Bullets cause vibrations in the slats that can weaken weld seams or loosen bolts, which is particularly the case for high-velocity bullets. The leaf-spring is formed from the steel bar as such, which means that the slats can be supported without weld seams and bolts, thus increasing the resistance to high-velocity bullets.

The support structure may have or be constituted by a first elongated flat steel bar and a second elongated flat steel bar, each having one or more features of the elongated steel bar described above. By limiting the number of flat steel bars to two, stricter tolerances between the steel bars and the steel slats can be used, which enables a tighter fitting of the steel slats and thereby a more durable slat arrangement.

Each steel slat of the slat arrangement may have a bent, curved, or folded transverse cross-section. This allows for a greater angle of incidence of a bullet. For example, such an arrangement can be suitable for standing, kneeling, and recumbent shooting.

Each steel slat may have an elongated first flat portion located at its front edge and stretching between its first end and its second end, and wherein the first flat portion is slanted with respect to the normal of the slat arrangement for changing the direction of a bullet hitting the first flat portion. Here, the first flat portion may define a normal at a first angle relative to the normal of the slat arrangement.

Each steel slat may further have an elongated second flat portion located at its back edge and stretching between its first end and its second end, and wherein the second flat portion is slanted with respect to the first flat portion for changing the direction of the bullet, or bullet fragments subsequent to the bullet hitting or passing the first flat portion. The second flat portion may define a normal at a second angle relative to the normal of the first flat portion. The first flat portion and the second flat portion may be connected along a fold of the slat. The second flat portion also has the effect of preventing ricochets or bullet fragments from going back through the slat arrangement.

The steel bar may connect to the second flat portion of each steel slat. This has the effect that the steel bar, at least to some extent, is shielded by the first flat portion, thereby reducing the risk of ricochets.

The slat arrangement may further comprise: a first steel plate for changing the direction of the bullet or bullet fragments subsequent to the bullet hitting a steel slat. The first steel plate may be positioned behind the steel slat or the slat arrangement. The first steel plate may be transverse to the normal of the slat arrangement. Alternatively or additionally, the first steel plate may define a normal parallel to or aligned with the normal of the slat arrangement.

The elongated first flat portions of the steel slats may have similar, or the same, transverse widths, and all pairs of neighboring steel slats may have similar, or the same, separations between them. Further, the transverse widths and the separations may be configured such that a bullet following a trajectory along the normal of the slat arrangement first hits a first flat portion of a steel slat prior to hitting any other part or portion of the slat arrangement. Alternatively, the transverse widths and the separations may be configured such that a bullet following a trajectory along the normal of the slat arrangement first hits a first flat portion or a second flat portion of a steel slat prior to hitting any other part or portion of the slat arrangement.

Each steel slat may have a first side edge at its first end and stretching between the front edge and the back edge, wherein the first side edge, or a portion of the side edge, is curved, slanted, or non-perpendicular, with respect to the front edge. Each steel slat may further have a second side edge at its second end and stretching between the front edge and the back edge, wherein the second edge is configured to conform to or match another edge similar to the first edge of the steel slat. This allows aligned steel slats to be placed with touching edges and also reduces the risk of a bullet forcing the steel slats apart. Also, if a gap appears between the aligned steel slats, the risk of a bullet passing through the gap is reduced.

The separation between neighboring steel slats may be in one or more of the ranges 35 to 65 mm, 40 to 60 mm, or 45 to 55 mm, or in one or more of the ranges, 35 to 40 mm, 40 to 45 mm, 45 to 50 mm, 50 to 55 mm, 55 to 60 mm, 60 to 65 mm. The transverse width of the first flat portions may be in one or more of the ranges 80 to 120 mm, 90 to 110 mm, or 95 to 105 mm, or in one or more of the ranges 80 to 90 mm, 90 to 100 mm, 100 to 110 mm, or 110 to 120 mm.

The first angle may be in one or more of the ranges 62° to 68°, 63° to 67°, 64° to 66°, 63° to 64°, 64° to 65°, 65° to 66°, or 66° to 67°. The second angle may be in one or more of the ranges 20° to 26°, 21° to 25°, 22° to 24°, 21° to 22°, 22° to 23°, 23° to 24°, or 24° to 25°.

According to a second aspect of the present invention a bullet trap is provided. The bullet trap comprises: a slat arrangement according to the first aspect of the present invention, wherein the slat arrangement is oriented for directing a bullet having a horizontal trajectory in a downward direction. Thus, the bullet trap may have all the features and provide all the effects described above in relation to the slat arrangement according to the first aspect.

The bullet trap may further comprise: a second steel plate positioned below the slat arrangement for stopping or changing direction of a bullet or fragments from a bullet subsequent to the bullet passing, or hitting and passing, the slat arrangement. This has the effect that the bullets or bullet fragments reach full stop vertically within a tight confinement, thus contributing to a more compact bullet trap. Additionally, the scrap material from the bullets will be collected without capture in another material, thus allowing for easy removal.

The second steel plate may have a first planar portion. The plane of the first planar portion plate may be aligned with the normal of the slat arrangement, or the first planar portion may define a normal transverse to, or perpendicular to the normal of the slat arrangement. Alternatively, the first planar portion may be inclined with respect to the normal of the slat arrangement, or define a normal at a third angle relative to the normal of the slat arrangement.

The bullet trap may further comprise: a third steel plate positioned below the slat arrangement for stopping or changing direction of a bullet or fragments from a bullet subsequent to the bullet hitting the second steel plate.

The third steel plate may have a second planar portion. The plane of the second planar portion plate may be transverse to the normal of the slat arrangement, or the second planar portion may define a normal along, or parallel with the normal of the slat arrangement. Alternatively, the second planar portion may be inclined with respect to the normal of the slat arrangement, or define a normal at a fourth angle relative to the normal of the slat arrangement. The bullet trap may further comprise a plate support for supporting the third steel plate. The third steel plate may be pivotally connected to the plate support for allowing it to swing if hit by a bullet or bullet fragment coming from the direction of the second steel plate. This allows for energy to dissipate without straining the construction, thus allowing for a longer lifetime. The third steel plate may be removably connected to the plate support, thus allowing for easier access to and maintenance of the parts of the bullet trap that are behind the third steel plate.

The plate support may comprise a proximal portion attached to the flat steel bar of the slat arrangement and a distal portion connecting to the third steel plate at an upper portion of the third steel plate. The third steel plate may hang on the distal portion. The third steel plate may be planar and/or have a rectangular shape. The third steel plate may be positioned in front of the slat arrangement. Alternatively or additionally, the third steel plate may be on the same elevation as the second steel plate. These features allow for a compact construction.

The bullet trap may further comprise: a conveyor system located below the slat arrangement for removing bullets or fragments of bullets from the bullet trap subsequent to the bullets or bullet fragments being stopped by the second steel plate or the third steel plate. This has the effect that maintenance of the bullet trap is reduced. The conveyor system may comprise a conveyor belt, wherein the conveyor belt is oriented with the conveyor belt running in a direction parallel to the elongated steel slats. This allows for a compact bullet trap that can be installed were floor area is limited. The conveyor belt comprises a metal surface for carrying the bullets or bullet fragments. Conveyor belts are commonly made of rubber. Bullet fragments reaching the conveyor belt are hot and may damage the rubber, thus limiting its lifetime. The metal surface makes the conveyor resilient to heat and replacements or repairs are avoided, thus reducing the required maintenance.

The conveyor belt may be positioned at the second steel plate and/or third steel plate. The second steel plate and/or the third steel plate may be inclined towards the conveyor belt for allowing bullets or bullet fragments to fall off onto the conveyor belt. This has the advantage of a compact construction. The conveyor system may comprise a frame for supporting the conveyor belt, and the second steel plate and/or third steel plate may be configured to shield the frame from bullets and bullet fragments subsequent to the bullets hitting the slat arrangement.

The third steel plate may be positioned above the conveyor belt. This has the effect that bullets and bullets fragments are more likely to end up on the conveyor belt.

The bullet trap may further comprise: a wall connector for connecting the bullet trap to a wall behind the bullet trap and for supporting the bullet trap in a horizontal direction. The wall connector comprises a portion of a vibration absorbing material for preventing vibrations caused by bullets hitting the slat arrangement from being conveyed to the wall via the wall connector.

The bullet trap may further comprise: a floor connector for connecting the bullet trap to a floor below the bullet trap and for supporting the bullet trap in a vertical direction. The floor connector may comprise a portion of a vibration absorbing material for preventing vibrations caused by bullets hitting the slat arrangement from being conveyed to the floor via the floor connector. The vibration absorbing material may be a cellular elastomer. The elastomer may be polyurethane. It has been shown that this setup will significantly reduce the spread of noise in a concrete building.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1A:
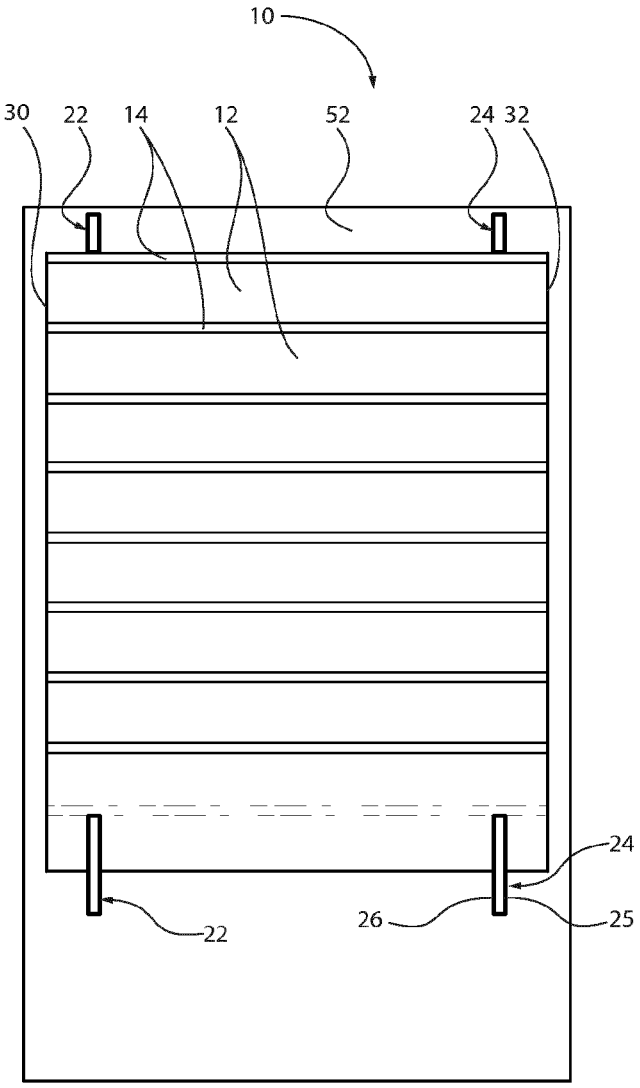
FIGS. 1*a* and 1*b* are a front view and a side view of a slat arrangement.
Figure 1B:
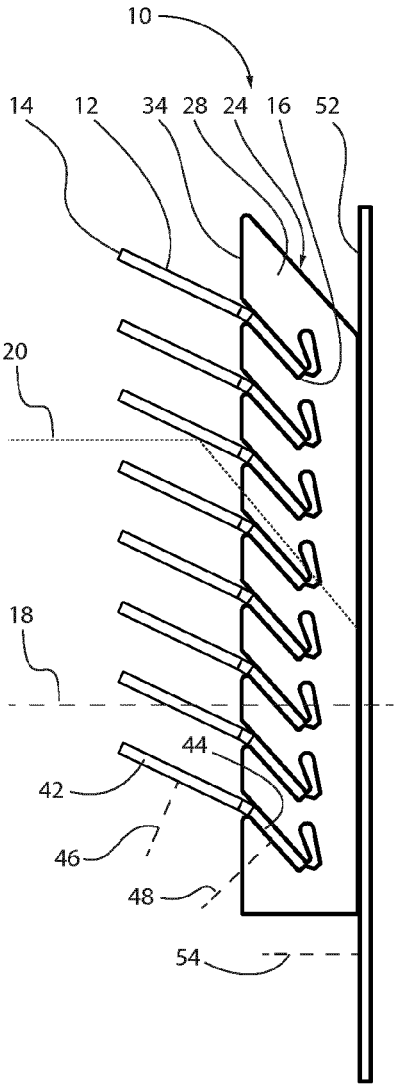

An embodiment of a slat arrangement 10 is illustrated in FIGS. 1*a* and 1*b*. The slat arrangement 10 has a number of steel slats 12 manufactured from 8 mm steel plates. This thickness is suitable for rifle ammunition, such as 7.62/10B. In other embodiments, the steel slats 12 are manufactured from 6.5 mm steel plates, which are suitable for pistol ammunition and lighter rifle ammunition, such as 9×19 39B and 5.56 5B. The steel slats 12 are positioned in a louver-like fashion, which means that they are parallel and slanted with respect to the normal 18 of the slat arrangement 10. The normal 18 is indicated by a dashed line in FIG. 1*b*, i.e. corresponding to a direction from right to left, or vice versa.

The separation between the front edges 14 is equal to the separation between the back edges 16 of neighboring steel slats 10. Also, as is shown in FIG. 1*b*, all pairs of neighboring steel slats have the same separations between them.

The front edges 14 of the steel slats 12 are parallel and define a common plane, i.e. they are coplanar, as is evident from in FIG. 1*b*. The normal 18 of the slat arrangement corresponds to the normal 18 of the common plane. A bullet fired straight at front of the slat arrangement has a direction or trajectory that is parallel to the normal 18.

The louver-like position of the steel slats 12 causes a bullet that follows a trajectory parallel to the normal 18 to change direction. In the orientation of the steels slats in FIGS. 1*a* and 1*b*, the new direction of the bullet will have a downward component subsequent to hitting a steel slat 12, as is illustrated by the dotted line 20.

The slat arrangement 10 also has a support structure in the form of a left, or first, flat steel bar 22 and a right, or second, flat steel bar 24. The steel bars are identical in shape. Each steel bar has a left, or first, side surface 26 and a right, or second, side surface 28 that are parallel to the normal 18 of the slat arrangement 10. This means that the profile of the steel bars 22 and 24 is minimized with respect to a shooter firing along the normal 18, and the risk of ricochets is reduced.

Each steel bar 22 and 24 connect to each steel slat 12 at the back edge 16 of the steel slat 12 and between the left end 30 and the right end 32 of the steel slat 12, thus supporting the steel slat 12. This construction has the effect that the risk of hitting the steel bars 22 and 24, i.e. the support structure, is reduced. Further, the left end 30 of a steel slat 12 is free to contact the right end of a steel slat of a neighboring slat arrangement without any frame between them. The right end 32 of a steel slat 12 is similarly able to contact the left end of a steel slat of another neighboring slat arrangement.

The steel slats 12 extend from the steel bars 22 and 24 in the general direction from which bullets will come. Thus, a bullet having a trajectory along the normal 18 of the slat arrangement 10 passes between the front edges 14 of a pair of neighboring steel slats 12 before it can reach the steel bars 22 and 24, i.e. the support structure.

Figure 3A:
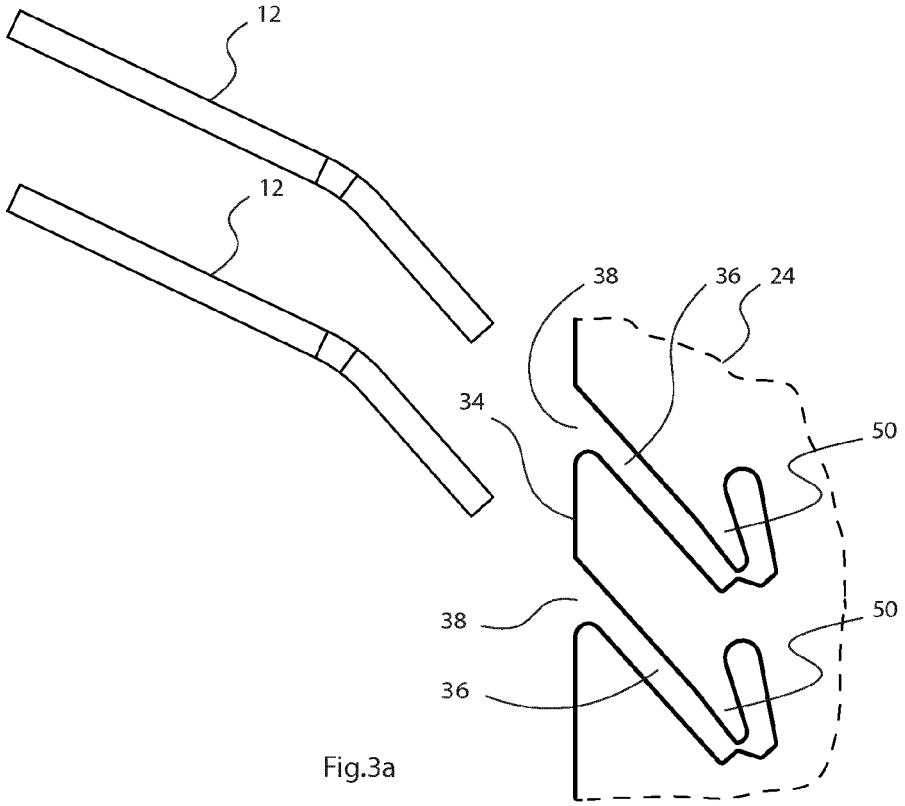
FIGS. 3*a* and 3*b* are side views of a steel bar and steel slats illustrating the mounting of the steel slats.
Figure 3B:
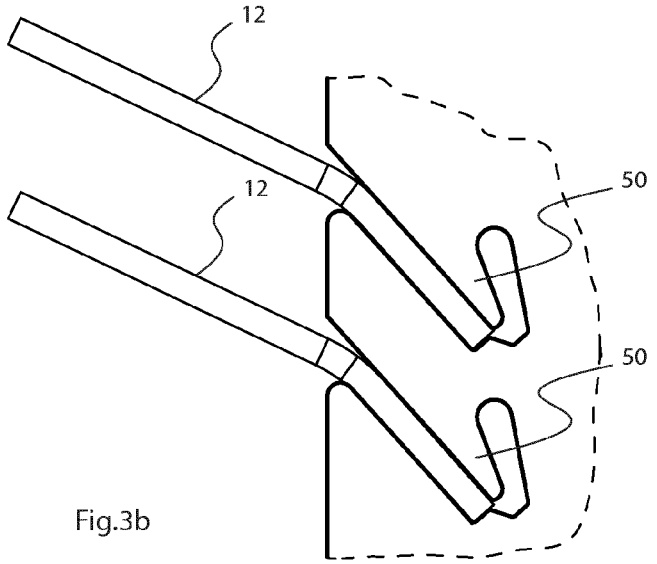

A portion of the right steel bar 24 is illustrated in FIGS. 3*a* and 3*b* and indicated by the dashed lines. The right steel bar has a first front edge 34 with a number of cut-outs 36 from the left side surface 22 to the right side surface 24, as is illustrated in FIG. 3*a*. Each cut-out 36 has an opening 38 in the first front edge 34.

Figure 2B:
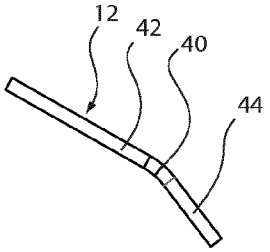
FIGS. 2*a*, 2*b*, and 2*c* are a front view, side view, and a top view, respectively, of a steel slat.
Figure 2A:
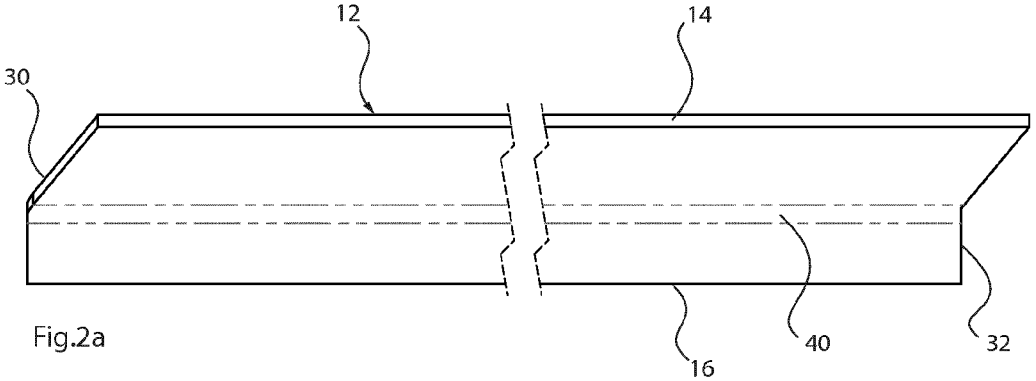
Figure 2C:
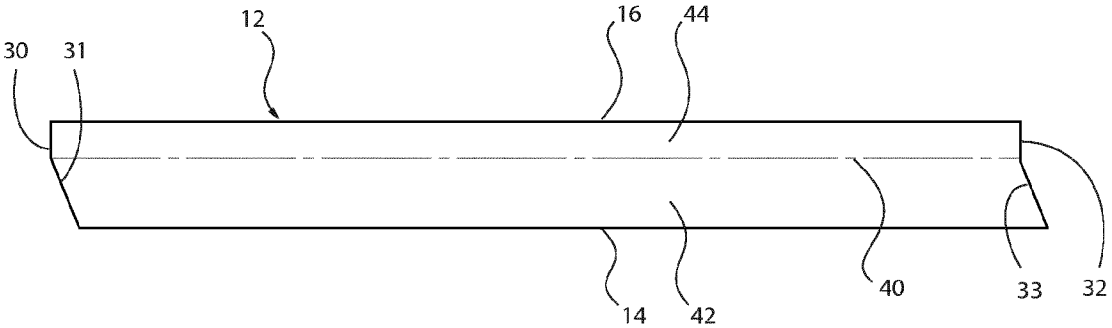

FIGS. 2*a*, 2*b*, and 2*c* are a front view, side view, and a top view, respectively, of a steel slat 12 as described in relation to FIGS. 1*a*, 1*b*, 3*a*, and 3*b*. The steel slat 12 is folded lengthwise and the fold 40 goes from the left end 30 to the right end 32 of the steel slat 12.

The steel slat 12 has a first side edge 31 at its first end 30 with a portion that is slanted, i.e. at a non-perpendicular angle, with respect to the front edge 14. The steel slat 12 further has a second side edge 33 at its second end 32 that is also slanted with respect to the front edge 14. The second side edge 33 is formed so that it would conform to the first side edge 31, should these two edges meet.

The steel slat 12 has an elongated first flat portion 42 located at its front edge 14 and stretching between its left end 30 and its right end 32. The first flat portion 42 is slanted with respect to the normal 18 of the slat arrangement 10, as is shown in FIG. 1*b*. The first flat portion 42 defines a normal 46 at a first angle relative to the normal 18 of the slat arrangement. The first angle is about 65°.

The steel slat 12 further has an elongated second flat portion 44 located at its back edge 16 and stretching between its left end 30 and its right end 32. The second flat portion 44 is slanted with respect to the first flat portion 42 and defines a normal 48 at a second angle relative to the normal 46 of the first flat portion 42. The second angle is about 23°. The first flat portion 42 and the second flat portion 44 are connected along the fold 40 of the steel slat 12.

The second flat portion 44 of each steel slat 12 is inserted in a cut-out 36 of the steel bar 24, as is illustrated in FIGS. 3*a* and 3*b* by inserting the second flat portion 44 through the opening 38 of the cut-out 36. This way, the cut-out 36 encloses a portion of a steel slat 12 located at its back edge 16 and the steel slat is connected to the steel bar 24.

Each cut-out 36 is be formed with a leaf-spring 50 that biases a portion of the steel slat 12 and maintains the position of the steel slat 12 with respect to the steel bar 24.

The separation between neighboring steel slats 12 is 40 mm. This is suitable for rifle ammunition, such as 7.62/10B. In other embodiments the separation is 50 mm, which is suitable for lighter rifle ammunition, such as 5.56 5B, or 40 mm, which is suitable for pistol ammunition, such as 9×19 39B.

The transverse width of the first flat portion 42 of each steel slat 12 is 102 mm. In FIG. 2*c*, the transverse width is at a right angle to the fold 40. The transverse widths and the separations between the steel slats are such that that a bullet following a trajectory along the normal 18 of the slat arrangement 12 first hits a first flat portion 46 of a steel slat prior to hitting any other part or portion of the slat arrangement 10.

The slat arrangement 10 also has a first or back steel plate 52, as shown in FIGS. 1*a* and 1*b*. The back steel plate 52 is transverse to the normal 18 of the slat arrangement 10. The back steel plate 52 is planar, which means that it defines a normal 54 parallel or aligned with the normal 18 of the slat arrangement 10. As is indicated by the trajectory 20 in FIG. 1*b*, bullet or bullet fragments will hit the back steel plate 52 after the bullet has hit a steel slat 12, which means that the back steel plate is configured for changing the direction of the bullet or bullet fragments.

Figure 4C:
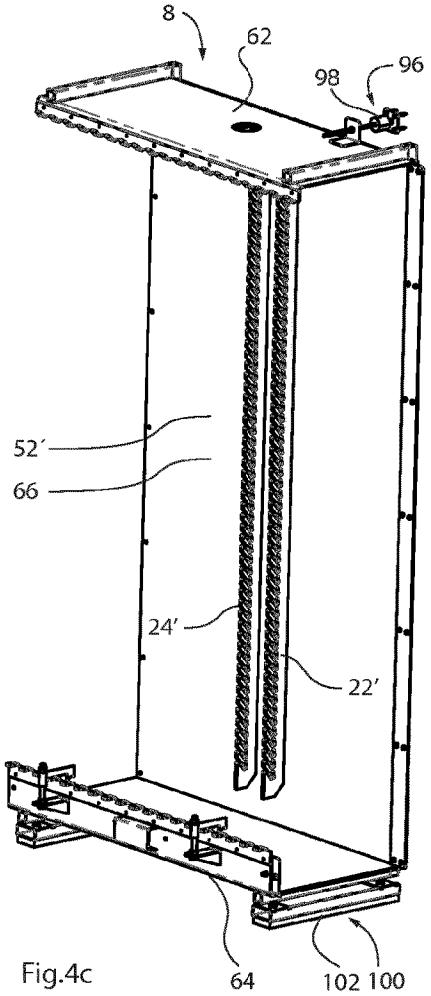
FIGS. 4*a*, 4*b*, and 4*c* are a side view, a front view, and a perspective view of a section of a bullet trap.
Figure 4B:
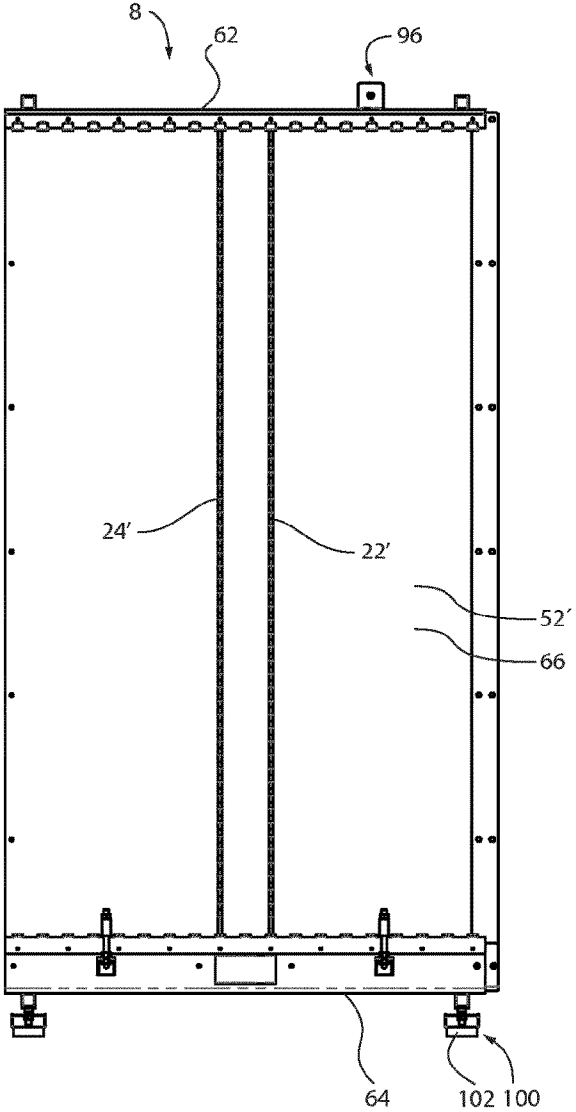
Figure 4A:
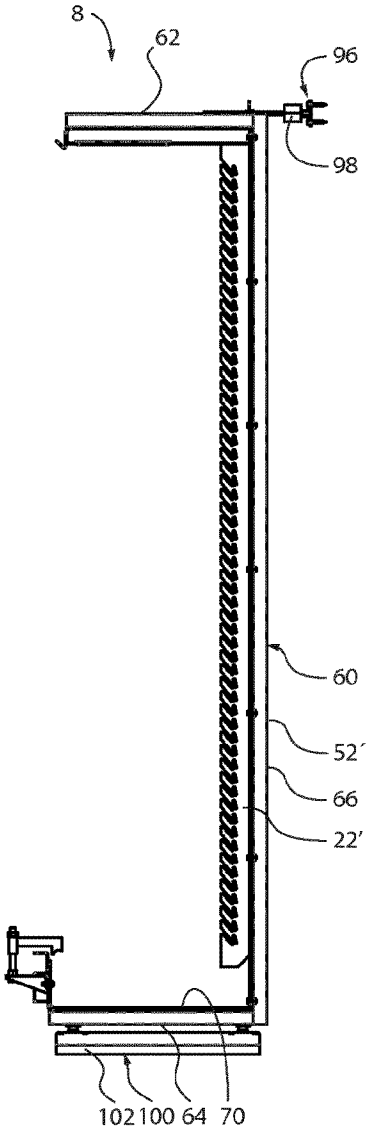

FIGS. 1*a*, 4*b*, and 4*c* are a side view, a front view, and a perspective view of a section of a bullet trap 8. The bullet trap 8 has a slat arrangement 10 similar to the one described in relation to FIGS. 1 to 3. However, the steel slats are not shown for the sake of clarity. Features having the same or similar functions as in FIGS. 1 to 3 have been given the same number indexing, but with a prime.

Each section 58 of the bullet trap 8 is composed of a housing 60 having a top portion 62, bottom portion 64, and a back portion 66. The back portion 66 also has the function of a back steel plate 52', as described in relation to FIGS. 1*a* to 1*c*.

Figure 5:
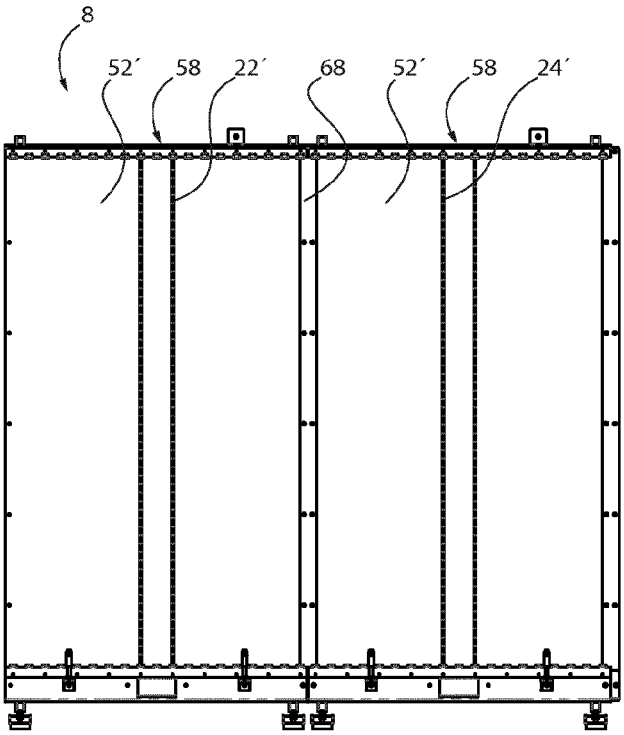
FIG. 5 is a front view two assembled sections of a bullet trap.

FIG. 5 illustrates two sections 58 positioned side by side and joined by a steel strip 68 connecting the back steel plates 52' of respective section 58. The left steel bar 22' and the right steel bar 24' of the slat arrangement are indicated in in FIG. 5. This means that the steel strip 68 is positioned at the middle of a steel slat supported by the left steel bar 22' and the right steel bar 24'. The steel slats of the bullet trap 8 are the same as those described in relation to FIGS. 1 to 3.

The bullet trap 8 also has a second steel plate 70 positioned behind and below the steel bars 22' and 24', i.e. below the slat arrangement, and forms part the bottom portion 64. The second steel plate 70 stops or redirects a bullet or fragments from a bullet after to the bullet has passed the slat arrangement.

The bullet trap 8 has a wall connector 96 that connects to a wall behind bullet trap 8. The wall connector 96 has a portion 98 of a vibration absorbing material that prevents vibrations caused by bullets hitting the slat arrangement from being conveyed to the wall via the wall connector 96. The bullet trap also has a floor connector 100 that connects the bullet trap 8 to a floor below the bullet trap 8. The floor connector 100 also has a portion 102 of the vibration absorbing material for preventing vibrations caused by bullets hitting the slat arrangement from being conveyed to the floor via the floor connector. The abovementioned vibration absorbing material is a cellular polyurethane.

Figure 6A:
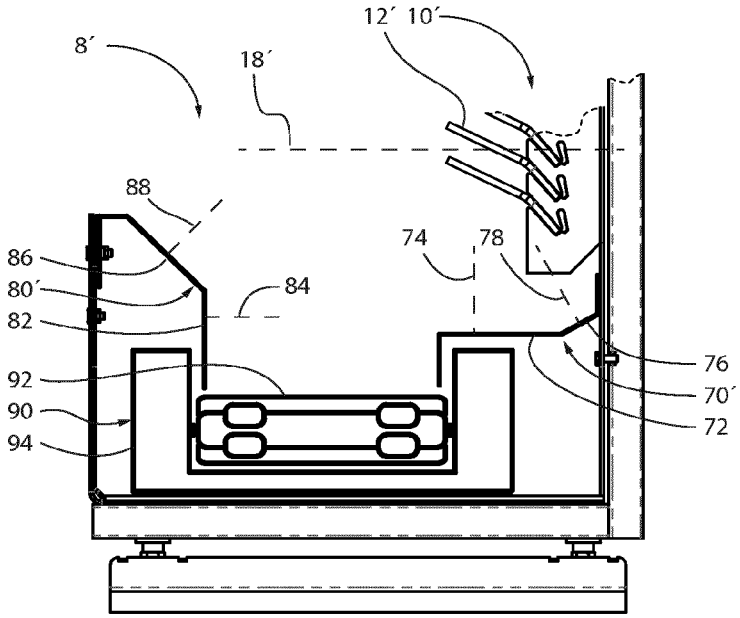
FIG. 6*a* is a side view of a bullet trap with a conveyor system.

A side view of the lower parts of an alternative embodiment of a bullet trap 8' is shown in FIG. 6*a*. Features having similar or identical functions as those of the bullet trap described in relation to FIGS. 1 to 4 have been given the same number indexing, but with an additional prime. The second steel plate 70' has a first planar portion 72. The first planar portion 72 is aligned with the normal 18' of the slat arrangement 10', as is shown in FIG. 7. This means that the first planar portion 72 defines a normal 74 transverse to, or perpendicular to the normal 18' of the slat arrangement 10'. The second steel plate 70' also has an additional first planar portion 76. The additional first planar portion 76 is inclined with respect to the normal 18' of the slat arrangement 10' and defines a normal 78 at a third angle of relative to the normal 18' of the slat arrangement 10'. The third angle is about 60°.

The bullet trap also has third steel plate 80' positioned below the slat arrangement 10 and in front of the second steel plate 70'. The third steel plate 80' stops or changes the direction of a bullet or fragments from a bullet subsequent to hitting the second steel plate 70'. The third steel plate 80' has a second planar portion 82 that is transverse to the normal 18' of the slat arrangement 10'. This portion effectively stops all bullets or bullet fragments coming from the second steel plate 70'. This means that the second planar portion 82 defines a normal 84 aligned with, or parallel with, the normal 18' of the slat arrangement 10'. The third steel plate 80' also has an additional second planar portion 86. The additional second planar portion 86 is inclined with respect to the normal 18' of the slat arrangement 10' and defines a normal 88 at a fourth angle of relative to the normal 18' of the slat arrangement 10'. The fourth angle is about 45°.

The bullet trap 8' has a conveyor system 90 located below the slat arrangement 10'. The conveyor system 90 has a conveyor belt 92 supported by a frame 94 and is oriented to run in a direction parallel to the steel slats 12'. The conveyor belt 92 is composed of metal links, thus having a metal surface that can carry bullets or bullet fragments. The second steel plate 70' and the third steel plate 80' shield the frame 94 from bullets and bullet after they have passed the slat arrangement 10'.

Figure 6B:
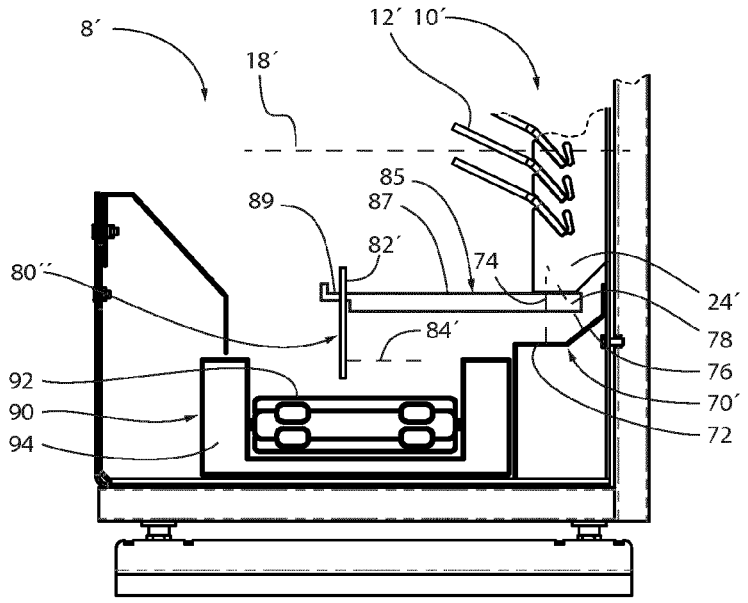
FIG. 6*b* is a side view of another bullet trap with a conveyor system.

A side view of the lower parts of another embodiment of a bullet trap 8' is shown in FIG. 6*b*. Features having identical functions as those of the bullet trap described in relation to FIG. 6*a* have been given the same number indexing, and features having a related function have been given the same number indexing, but with an added prime.

The bullet trap has a planar third steel plate 80''' positioned below the slat arrangement 10' and in front of the second steel plate 70'. The third steel plate 80" stops a bullet or fragments from a bullet subsequent to hitting the second steel plate 70'.

Figure 6C:
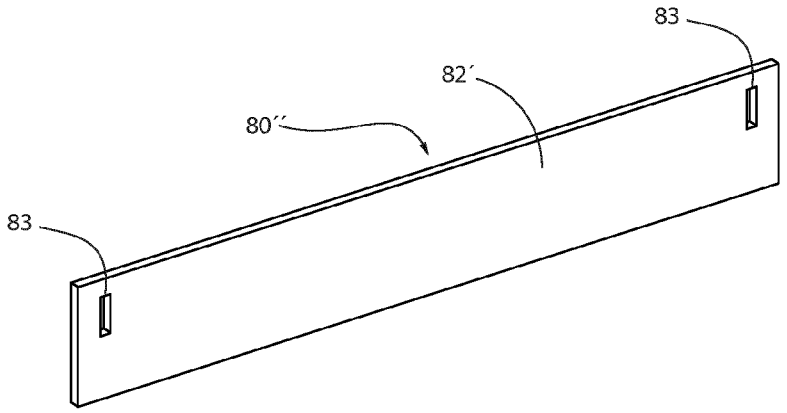
FIG. 6*c* is a perspective view of the third steel plate described in relation to FIG. 6*b*, and FIGS. 7*a* and 7*b* are a front view and a side view of an alternative embodiment of a slat arrangement.

The third steel plate 80", which is further shown in FIG. 6*c*, is rectangular and defines a second planar portion 82'. A rectangular through-going hole 83 is located at each of the ends and on the upper side of the third steel plate 80".

The bullet trap 8' has a plate support 85 in the form of an elongated steel plate. The plate support 85 is coplanar with the right flat steel bar 24' and has a proximal portion 87 that is welded to the bottom edge of the right flat steel bar 24'. The plate support 85 also has a distal portion 89 that is connected to the proximal portion 87 and that is inserted in one of the through-going holes 83. This way, the plate support 85 supports one end of the third steel plate 80".

The height of the proximal portion 87 is greater than the height of the through-going hole 83, thus preventing the third steel plate 80" from moving towards the slat arrangement 10'. The distal portion 89 has an upward extending protrusion that prevents the third steel plate 80" from falling off the plate support 85. The distal portion 89 is of sufficient length for two similar steel plates to be placed thereon. The distal portion 89, and thus also the third steel plate 80", are positioned above the conveyor belt 92 of the conveyor system 90.

Another plate support (not shown), similar to the one shown in FIG. 6*b*, is attached to a left flat steel bar (not shown) and engages the other through-going hole 83, thus supporting the other end of the third steel plate 80" in a corresponding manner as described above.

The height of the through-going hole 83 is greater than the height of the distal portion 89, thus allowing the third steel plate 80" to hang freely on the plate support 85 and swing back and forth when hit by a bullet or bullet fragments coming from the second steel plate 70'. When at rest, the third steel plate 80", or the second planar portion 82', are transverse to the normal 18' of the slat arrangement 10'. This means that the second planar portion 82' defines a normal 84' aligned with, or parallel with, the normal 18' of the slat arrangement 10'.

The third steel plate 80" can be lifted off the plate support 85, thus allowing for an easy maintenance of the conveyor system 90 and the part of the bullet trap 8' located behind the third steel plate 80".

Figure 7A:
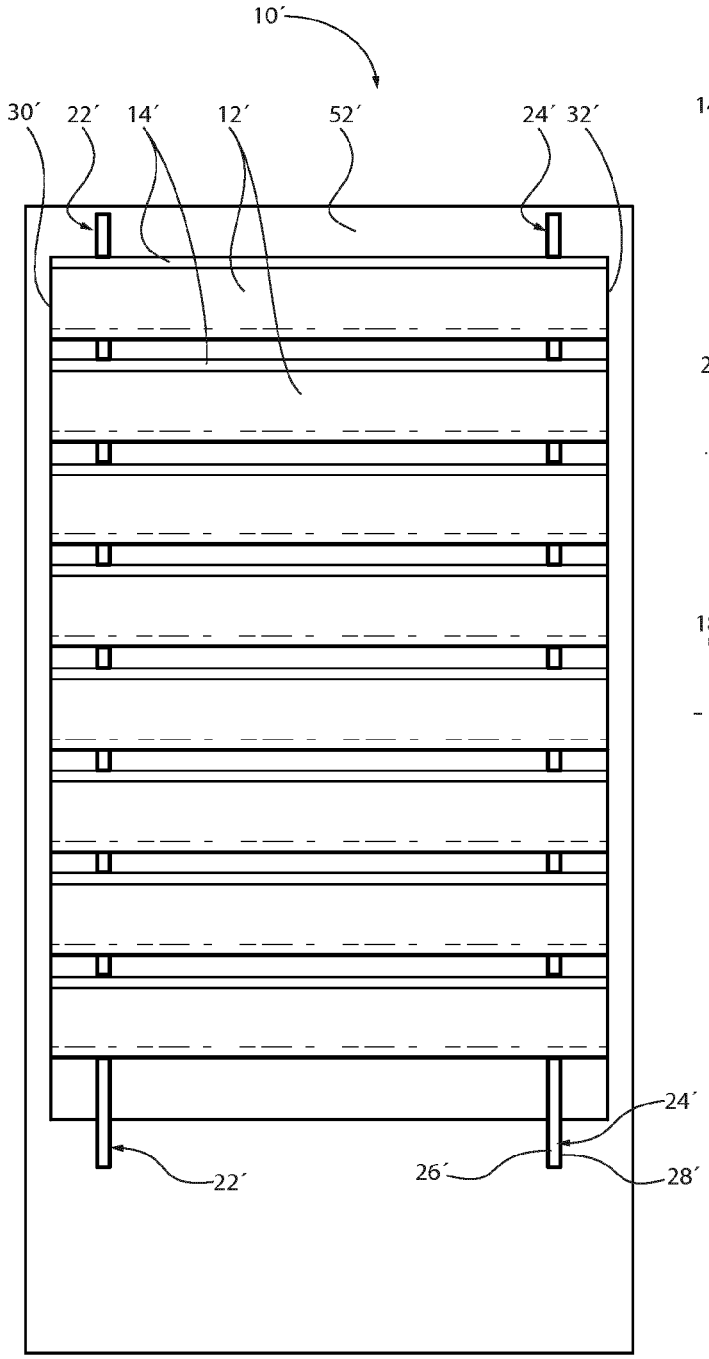
Figure 7B:
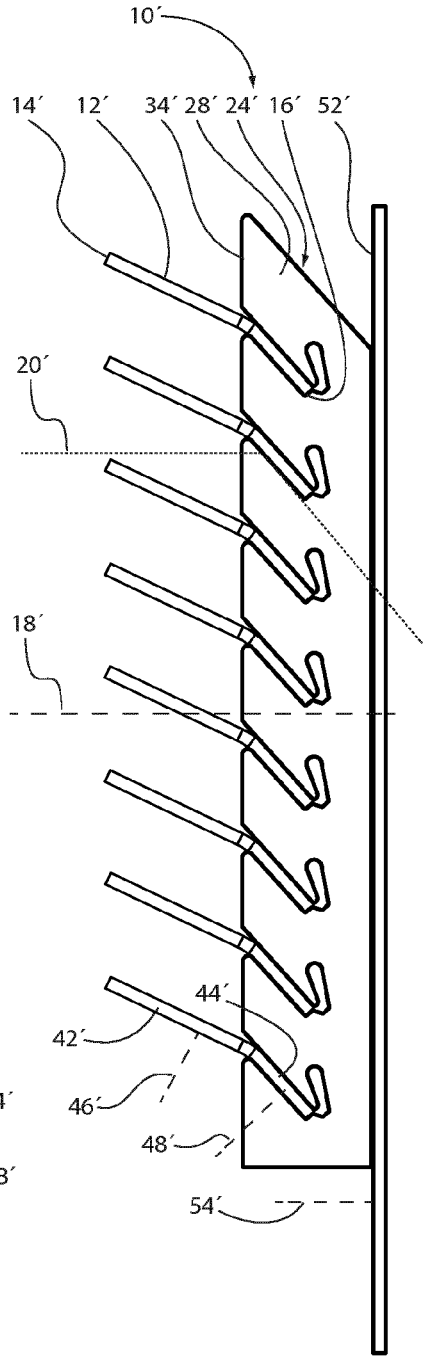

FIGS. 7*a* and 7*b* illustrate a front view and a side view of an alternative embodiment of a slat arrangement 10'. Features in common with the embodiment described in relation to FIGS. 1*a* and 1*b* have the same number index, but with a prime. The embodiment of FIGS. 1*a* and 7*b* differs in that the spacing between the slats 12' is greater so that a bullet with a trajectory along the normal 18' also can hit the second flat portion 44' directly.

ITEM LIST

8 bullet trap
10 slat arrangement
12 steel slats
14 front edge
16 back edge
18 normal of slat arrangement
20 bullet trajectory
22 left flat steel bar
24 right flat steel bar
26 left side surface
28 right side surface
30 left end of steel slat
32 right end of steel slat
34 front edge of steel bar
36 cut-out
38 opening
40 fold
42 first flat portion
44 second flat portion

46 normal of first flat portion
48 normal of second flat portion
50 leaf-spring
52 back steel plate
54 normal of back steel plate
58 section of bullet trap
60 housing
62 top portion
64 bottom portion
66 back portion
68 steel strip
70 second steel plate
72 first planar portion
74 normal of first planar portion
76 additional first planar portion
78 normal of additional first planar portion
80 third steel plate
82 second planar portion
83 through-going hole
84 normal of second planar portion
85 plate support
86 additional second planar portion
87 proximal portion
88 normal of additional second planar portion
89 distal portion
90 conveyor system
92 conveyor belt
94 frame
96 wall connector
98 portion of a vibration absorbing material
100 floor connector
102 portion of a vibration absorbing material

The invention claimed is:

1. A slat arrangement for changing the direction of a bullet, wherein the slat arrangement comprises:

a plurality of elongated steel slats, wherein each elongated steel slat has a longitudinal front edge and a longitudinal back edge extending between a first end and a second end; and a support structure supporting the plurality of steel slats;

wherein the steel slats are positioned in a louver-like fashion configured so as to be capable of changing the direction of a bullet following a trajectory normal to the slat arrangement;

wherein the support structure is connected to each steel slat at the back edge of the steel slat and between the first end and the second end of the steel slat;

wherein each steel slat has a first side edge at its first end, the first side edge extending between the front edge and the back edge;

wherein each steel slat further has a second side edge at its second end extending between the front edge and the back edge, the second side edge having a configuration conforming to a steel slat side edge having a configuration of the first side edge; and wherein at least a portion of each of the first and second side edges contacts the front edge of the steel slat and is curved, slanted, or non-perpendicular with respect to the front edge.

2. The slat arrangement according to claim 1, wherein the support structure is connected to each steel slat at a point distant from the first end and from the second end of the steel slat.

3. The slat arrangement according to claim 2, wherein one of the first end and the second end of each steel slat is free so as to be permitted to contact an end of a steel slat of a neighboring slat arrangement.

4. The slat arrangement according to claim 3, wherein:

the support structure comprises an elongated flat steel bar having an elongated first side surface and an elongated second side surface; and wherein the steel bar has a first front edge and comprises a plurality of cut-outs from the first side surface to the second side surface, each cut-out having an opening at the first front edge and encloses a portion of a steel slat that is located at the back edge of the steel slat.

5. The slat arrangement according to claim 1, wherein each steel slat has a bent, curved, or folded transverse cross-section.

6. The slat arrangement according to claim 5, wherein:

each steel slat has an elongated first flat portion located at its front edge and stretching between its first end and its second end;

the first flat portion is slanted with respect to the normal of the slat arrangement so as to be capable of changing the direction of a bullet hitting the first flat portion;

each steel slat further has an elongated second flat portion located at its back edge and stretching between its first end and its second end; and the second flat portion is slanted with respect to the first flat portion.

7. The slat arrangement according to claim 6, wherein the support structure comprises an elongated flat steel bar having an elongated flat first side surface and an elongated flat second side surface, wherein:

the first side surface and the second side surface are parallel, and the flat steel bar is positioned with the first side surface and the second side surface parallel to the normal of the slat arrangement; and the steel bar connects to each steel slat at the back edge of the steel slat and to the second flat portion of each steel slat.

8. The slat arrangement according to claim 6, wherein the first flat portion defines a normal at a first angle relative to the normal of the slat arrangement, and wherein the first angle is in the range of 62° to 68°.

9. The slat arrangement according to claim 8, wherein the second flat portion defines a normal at a second angle relative to the normal of the first flat portion, and wherein the second angle is in the range of 20° to 26°.

10. The slat arrangement according to claim 6, wherein the elongated first flat portions of the steel slats have the same transverse widths.

11. The slat arrangement according to claim 10, wherein all pairs of neighboring steel slats have the same separation between them.

12. The slat arrangement according to claim 6, wherein the elongated first flat portions of the steel slats and the separation between neighboring steel slats is configured to cause a bullet following a trajectory normal to the slat arrangement to hit a first flat portion of one of the steel slats prior to hitting any other portion of the slat arrangement.

13. A bullet trap comprising a slat arrangement oriented for directing a bullet having a horizontal trajectory in a downward direction, wherein the slat arrangement comprises:

a plurality of elongated steel slats, wherein each elongated steel slat has a longitudinal front edge and a longitudinal back edge stretching between a first end and a second end; and a support structure supporting the plurality of steel slats;

wherein the steel slats are positioned in a louver-like fashion configured so as to be capable of changing the direction of a bullet following a trajectory aligned with a normal of the slat arrangement;

wherein each steel slat has a first side edge at its first end extending between the front edge and the back edge;

wherein each steel slat further has a second side edge at its second end extending between the front edge and the back edge, the second side edge having a configuration conforming to a steel slat side edge having a configuration of the first side edge;

wherein at least a portion of each of the first and second side edges contacts the front edge of the steel slat and is curved, slanted, or non-perpendicular with respect to the front edge of the steel slat; and wherein the support structure is connected to each steel slat at the back edge of the steel slat and between the first end and the second end of the steel slat.

14. The bullet trap according to claim 13, wherein the slat arrangement further comprises:

a first steel plate configured so as to be capable of changing the direction of the bullet or bullet fragments subsequent to the bullet hitting a slat, wherein the first steel plate is positioned behind the steel slat, and wherein the first steel plate defines a normal aligned with the normal of the slat arrangement.

15. The bullet trap according to claim 14, further comprising a second steel plate positioned below the slat arrangement so as to be capable of stopping or changing the direction of a bullet or fragments from a bullet subsequent to the bullet passing the slat arrangement, wherein the second steel plate has a first planar portion inclined with respect to the normal of the slat arrangement.

16. The bullet trap according to claim 15, further comprising a third steel plate positioned below the slat arrangement so as to be capable of stopping or changing the direction of a bullet or fragments from a bullet subsequent to the bullet hitting the second steel plate, wherein the third steel plate has a second planar portion inclined with respect to the normal of the slat arrangement.

17. The bullet trap according to claim 16, further comprising a conveyor system located below the slat arrangement and configured for removing bullets or fragments of bullets from the bullet trap subsequent to the bullets or bullet fragments being stopped by the second steel plate or the third steel plate.

18. The bullet trap according to claim 17, wherein the conveyor system comprises a conveyor belt positioned at the second steel plate and the third steel plate, and wherein the second steel plate and the third steel plate are inclined towards the conveyor belt so as to allow bullets or bullet fragments to fall off onto the conveyor belt.

* * * * *